US005787912A

United States Patent [19]

Wu

[11] Patent Number: 5,787,912

[45] Date of Patent: Aug. 4, 1998

[54] QUICKLY FOLDABLE RIB MEANS OF AUTOMATIC UMBRELLA

[76] Inventor: Tzun-Zong Wu, P.O. Box 55-846, Taipei, Taiwan

[21] Appl. No.: 951,836

[22] Filed: Oct. 16, 1997

[51] Int. Cl.[6] ..... A45B 25/00

[52] U.S. Cl. ..... 135/29; 135/31

[58] Field of Search ..... 135/22, 24, 25.1, 135/25.3, 25.31, 25.32, 25.4, 26, 29, 31

[56] References Cited

U.S. PATENT DOCUMENTS

| | | | |
|---|---|---|---|
| 4,658,844 | 4/1987 | Ping | 135/29 X |
| 4,966,180 | 10/1990 | Lai | 135/26 X |
| 5,063,953 | 11/1991 | Wu | 135/31 X |
| 5,193,565 | 3/1993 | Huang | 135/29 X |
| 5,235,998 | 8/1993 | Liu | 135/29 X |
| 5,337,770 | 8/1994 | Wang | 135/29 X |
| 5,392,799 | 2/1995 | Lai | 135/31 X |
| 5,536,334 | 7/1996 | Yang | 135/31 X |
| 5,645,094 | 7/1997 | Wu | 135/31 X |

*Primary Examiner*—Lanna Mai

[57] ABSTRACT

A rib assembly adapted for use in an automatic umbrella includes: a top rib pivotally secured to an upper notch fixed on a top of a central shaft of the umbrella, a stretcher rib pivotally connected between the top rib and a runner slidably held on the central shaft, a middle rib pivotally secured between the top rib and a rear rib, and a spring rib pivotally connected between the top rib and the rear rib; characterized in that the spring rib has an inner rib portion formed with a convex spring portion overriding on a lug of a pair of lugs which are provided for pivotally connecting the middle rib with the top rib and a concave deflection portion deflecting the convex portion of the spring rib towards a U-shaped groove of the middle rib, thereby exerting spring force on the convex and concave portion for resiliently restoring the rib assembly from an unfolded state to a folded state for quickly closing the umbrella.

1 Claim, 5 Drawing Sheets

26
P1
25
28
223
222
283
281
251
252
224
62
6
P
27
61
C
22
2
23
221
21
24
12
1
5
15
11
4
3
25u
282
22
223
27
251
222
283
281
252
28

T
26
262
261
253
284
P1
28
283a
25
222
282a
281
251
252
62
6
P
C
27
2
61
22
221
23
21
24
12
5
1
15
11
4
3
25x
25u
223
272

26
261
253
P1
262
284
28
250
25
283a
282a
222
251
223
281
252
224
62
272
6
P
C
61
27
2
271
22
221
21
23
D
24
1
5
4
3

QUICKLY FOLDABLE RIB MEANS OF AUTOMATIC UMBRELLA

BACKGROUND OF THE INVENTION

A conventional rib means 2 as used in an automatic umbrella for securing an umbrella cloth C thereon is shown in FIGS. 1–5, which includes: a top rib 22 pivotally secured to an upper notch 21 formed on a top portion of an upper tube 12 of a central shaft 1, a stretcher rib 23 pivotally connected between a runner 24 slidably held on the central shaft 1 and the top rib 22, a middle rib 25 pivotally connected between a rear rib 26 and an intermediate connecting rib 27 which is pivotally secured to the stretcher rib 23, and a spring rib 28 pivotally secured between the top rib 22 and the rear rib 26. The ribs of the rib means 2 form two sets of parallelogram linkage for the folding and unfolding mechanism of the umbrella.

The automatic umbrella has an opening spring 5 resiliently retained in the central shaft 1 consisting of the upper tube 12, a middle tube 15 and a lower tube 11 secured to a grip 3 having a control device 4 provided in the grip 3 for controlling the opening or closing of the umbrella; and at least a closing spring 6 retained on the rib means 2 which an inner spring end 61 secured to an inner portion of the intermediate connecting rib 27 and an outer spring end 62 secured to an outer portion 224 of the top rib 22.

The top rib 22 has its inner end portion 221 pivotally secured to the upper notch 21, an outermost end portion 222 pivotally connected with a pair of lugs 251 formed on opposite side walls of the middle rib 25, and an outer end portion 223 adjacent to the outermost end portion 222 for pivotally connecting an innermost hook portion 281 of the spring rib 28.

The spring rib 28 has a generally C-shaped inner portion including an innermost end portion 281 secured to the outer end portion 223 of the top rib 22, a flat (or horizontal) rib portion 282 following the innermost end portion 281 to be generally parallel to the middle rib 25 when opening the umbrella and extending the rib means 2 as shown in FIG. 1, and a bending portion 283 deflecting towards a longitudinal center of the middle rib 25 having a cross section of U shape (25u). Since the generally C-shaped inner portion (281,282, 283) of the middle rib 25 is juxtapositional to the pair of lugs 251 of the middle rib 25 and generally horizontal or parallel to the middle rib 25 without forming vertically convex or concave spring portion, there is no "pushing force" or "spring force" stored on the spring rib 28 when the umbrella is opened, whereby upon closing of the umbrella by retracting the rib means 2 as urged by the closing spring 6, the spring rib 28 is not initiated by such "spring force" for folding the rib means 2, thereby influencing a quickly closing operation of the umbrella.

Meanwhile, when it is intended to open the umbrella by raising (U) and extending (E) the rib means 2 as shown in FIGS. 4, 5, the inner portion (281,282,283) of the spring rib 28 as generally parallel to the middle rib 25 will make the outer parallelogram linkage P1 to approximate the inner parallelogram linkage P to thereby crowd the two linkages (P,P1) and delay the unfolding operation of the rib means 2 when opening the umbrella.

The present inventor has found the drawbacks of the conventional rib means of the automatic umbrella, and invented the present rib means which is quickly foldable.

SUMMARY OF THE INVENTION

The object of the present invention is to provide a rib assembly adapted for use in an automatic umbrella including: a top rib pivotally secured to an upper notch fixed on a top of a central shaft of the umbrella, a stretcher rib pivotally connected between the top rib and a runner slidably held on the central shaft, a middle rib pivotally secured between the top rib and a rear rib, and a spring rib pivotally connected between the top rib and the rear rib; characterized in that the spring rib has an inner rib portion formed with a convex spring portion overriding on a lug of a pair of lugs which are provided for pivotally connecting the middle rib with the top rib and a concave deflection portion deflecting the convex portion of the spring rib towards a U-shaped groove of the middle rib, thereby exerting spring force on the convex and concave portion for resiliently restoring the rib assembly from an unfolded state to a folded state for quickly closing the umbrella.

DETAILED DESCRIPTION

Figures 1, 2, 3:
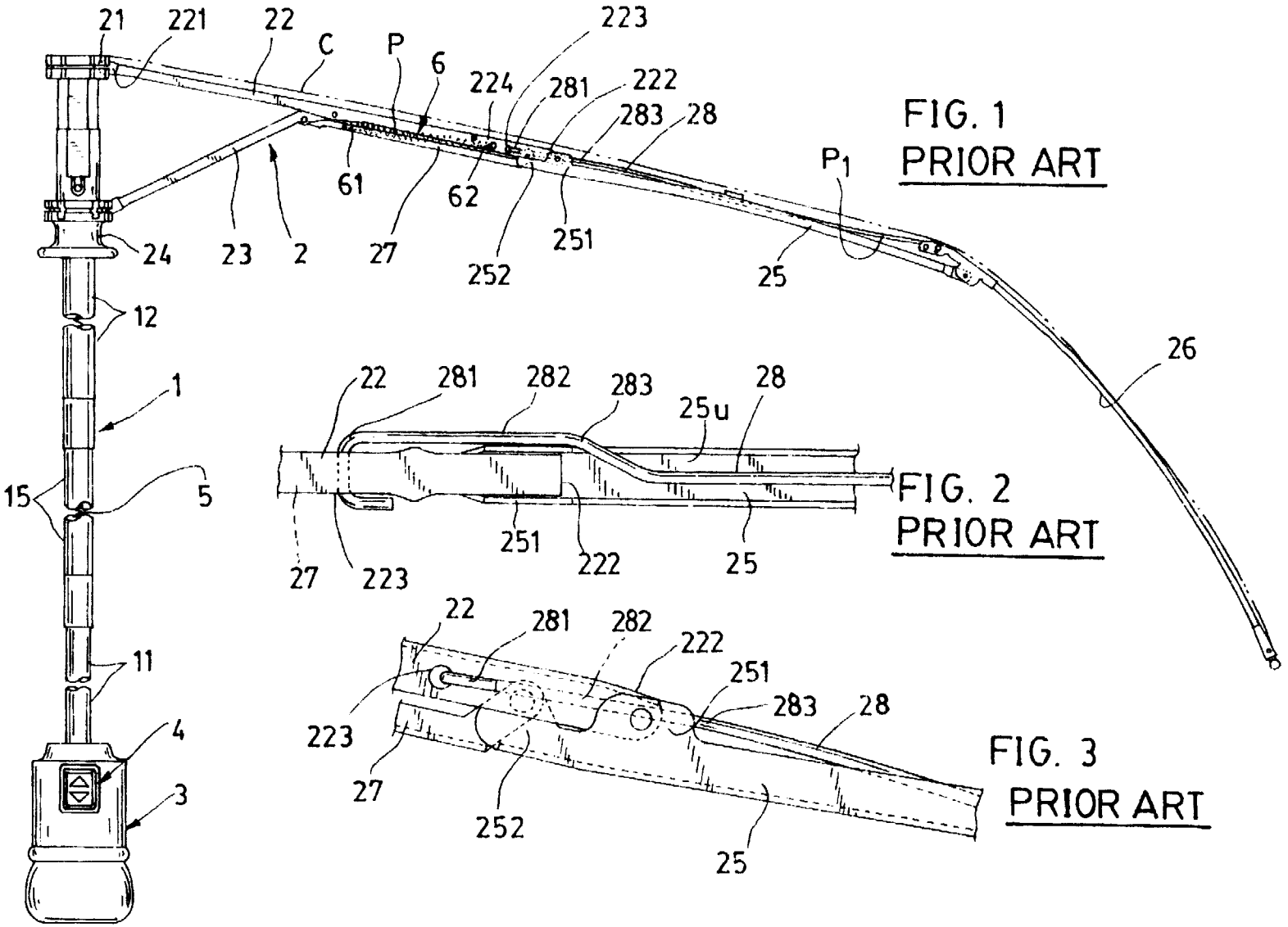
FIG. 1 PRIOR ART
FIG. 2 PRIOR ART
FIG. 3 PRIOR ART
FIG. 1 is an illustration showing a conventional automatic umbrella when opened.
FIG. 2 is a top view of the rib means as viewed from FIG. 1.
FIG. 3 is a front view of the rib means of FIG. 2.
Figure 4:
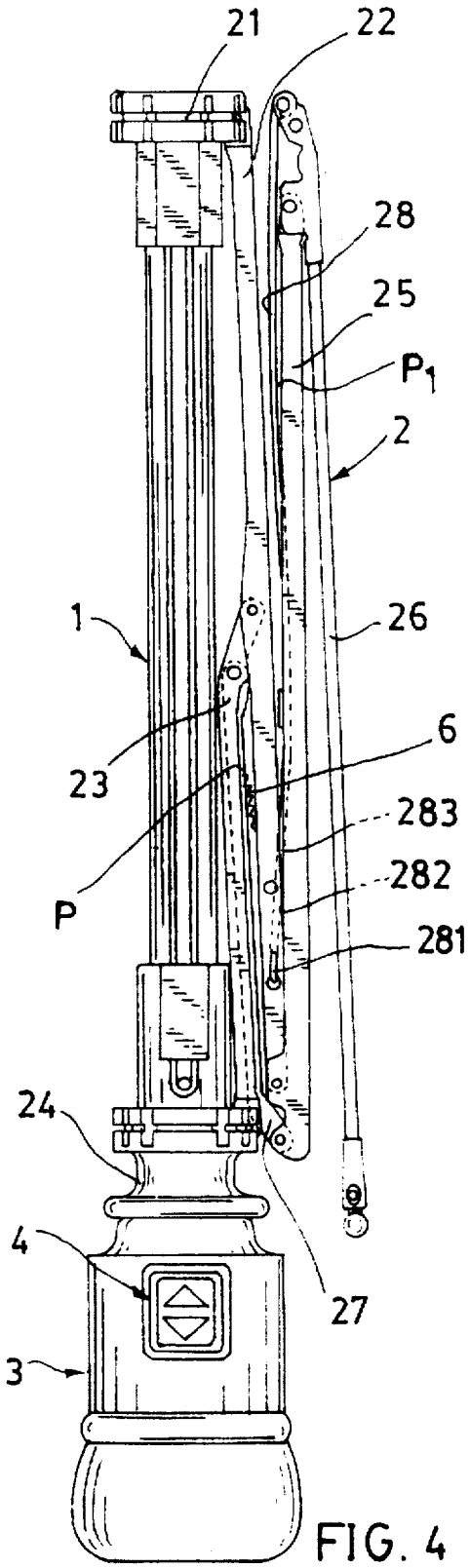
FIG. 4 PRIOR ART
FIG. 4 shows a closed umbrella when folded from FIG. 1.
Figure 5:
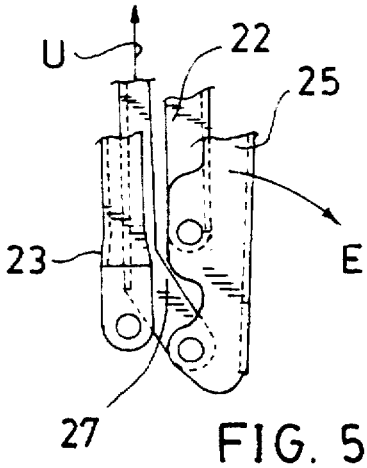
FIG. 5 PRIOR ART
FIG. 5 trial illustration of the rib means as shown in FIG. 4.

As shown in FIGS. 6–12, the present invention comprises: a rib means 2 pivotally secured to a central shaft 1 having a grip 3 secured to a lower portion of the central shaft 1 and a control device 4 formed in the grip 3 for controlling the opening and closing of the umbrella, an opening spring 5 retained in the central shaft 1 for opening the umbrella, and at lest a closing spring 6 retained on the rib means 2 for closing the umbrella. An umbrella cloth C is secured on the rib means 2. The central shaft 1 includes a lower tube 11 secured to the grip 3, a middle tube 15 telescopically engageable with the lower tube 11, and an upper tube 12 telescopically engageable with the middle tube 15.

The automatic umbrella of the present invention may be made as triple folds, but may be modified to be two folds or multiple folds, not limited in the present invention. The automatic umbrella can be automatically closed or opened by depressing a push button of the control device 4 formed on the grip 3.

The rib means 2 includes: a top rib 22 having its inner end portion 221 pivotally secured to an upper notch 21 fixed on a top of the central shaft 1, a stretcher rib 23 pivotally connected between the top rib 22 and a runner 24 slidably held on the central shaft, 1, a middle rib 25 having a pair of lugs 251 protruding upwardly (or outwardly) from opposite side walls of an U-shaped groove 25u of the middle rib 25 for pivotally connecting an outermost end portion 222 of the top rib 22 on the pair of lugs 251 of the middle rib 25, a rear rib 26 having an inner portion 261 pivotally connected with an outer end portion 253 of the middle rib 25, an intermediate connecting rib 27 having an inner end portion 271 pivotally connected to an outer portion of the stretcher rib 23 and an outer end portion 272 pivotally connected with an innermost end portion 252 of the middle rib 25, and a spring rib 28 having an innermost end portion 281 formed as a hook portion secured in a hook hole 223 formed in an outer portion of the top rib 22 and an outer end portion 284 pivotally connected with an innermost end portion 262 of the rear rib 26. The spring rib 28 has its middle rib portion slidably confined within a coupling ring 250 retained on a middle portion of the middle rib 25.

The closing spring 6 has its inner spring end 61 secured to an inner portion of the intermediate connecting rib 27 and an outer spring end 62 secured to an outer portion 224 of the top rib 22.

A first set of parallelogram linkage P is formed by the top rib 22, the stretcher rib 23, the intermediate connecting rib 27 and the middle rib 25; while a second set of parallelogram linkage P1 is formed by the middle rib 25, the top rib 22, the spring rib 28, and the rear rib 26. The two sets of parallelogram linkage P, P1 are provided as a folding or unfolding mechanism for closing or opening the umbrella of the present invention.

The spring rib 28 includes: an innermost hook portion 281 pivotally secured in a hook hole 223 formed in an outer portion of the top rib 22, a convex spring portion **282*a* connected to the innermost hook portion 281 and convex upwardly to override the outermost end portion 222 of the top rib 22 and at least a lug 251 of the middle rib 25, and a concave deflection portion 283*a* concave downwardly from the convex spring portion 282*a* and obliquely orienting towards the U-shaped groove 25*u* of the middle rib 25 to be projectively align with a longitudinal axis 25*x* defined at a longitudinal center of the middle rib 25**.

The concave deflection portion **283*a* of the spring rib 28** defines an obtuse angle ranging from 135 to 150 degrees, but not limited in the present invention.

Figures 6, 7, 8:
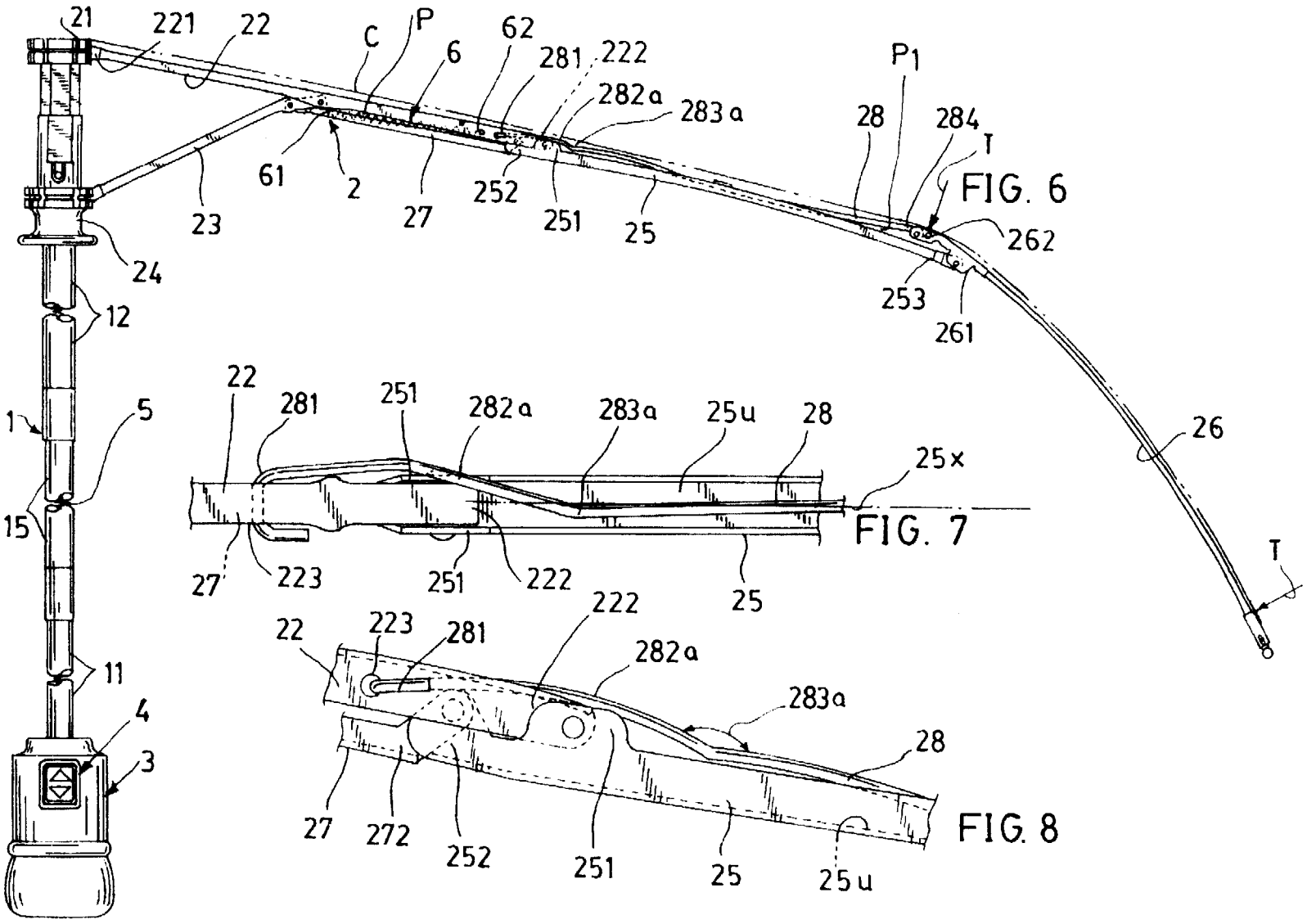
FIG. 6 is an illustration showing an opened automatic umbrella of the present invention.
FIG. 7 is a top view of the rib means of the present invention.
FIG. 8 is a front view of the rib means of FIG. 7.
Figures 9, 10:
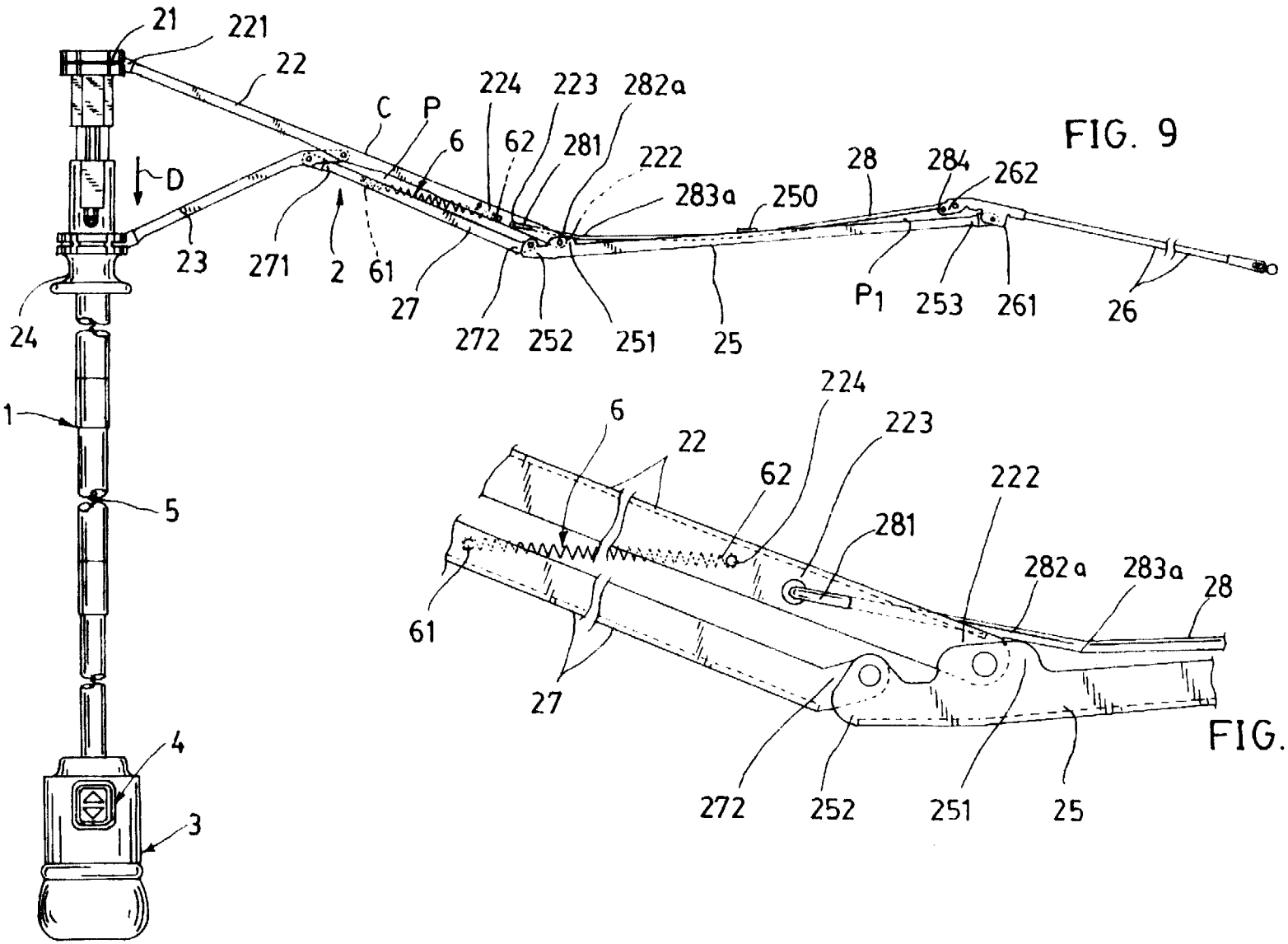
FIG. 9 shows the umbrella as being closed.
FIG. 10 shows a partial rib means of the umbrella as shown in FIG. 9.

Accordingly, the convex spring portion **282*a* and the concave deflection portion 283*a* of the spring rib 28 will store its spring energy when the rib means 2 is extended and the umbrella is opened as shown in FIG. 6. The spring energy is especially effected by the tension force T of the umbrella cloth C because the tension force T is downwardly acting against the rib means 2 for tightly compressing the convex spring portion 282*a* (FIGS. 6, 8) of the spring rib 28. After depressing the control device 4 for closing the umbrella for lowering (D) the runner 24 as shown in FIGS. 9, 10, the closing spring 6 will retract the rib means 2 and the spring force as inherently stored in the inner rib portion (281,282*a*, 283*a*) of the spring rib 28 will help restore the rib means 2 for a quicker folding operation of the ribs of the rib means 2** for accelerating the folding operation of the present invention.

Figure 11:
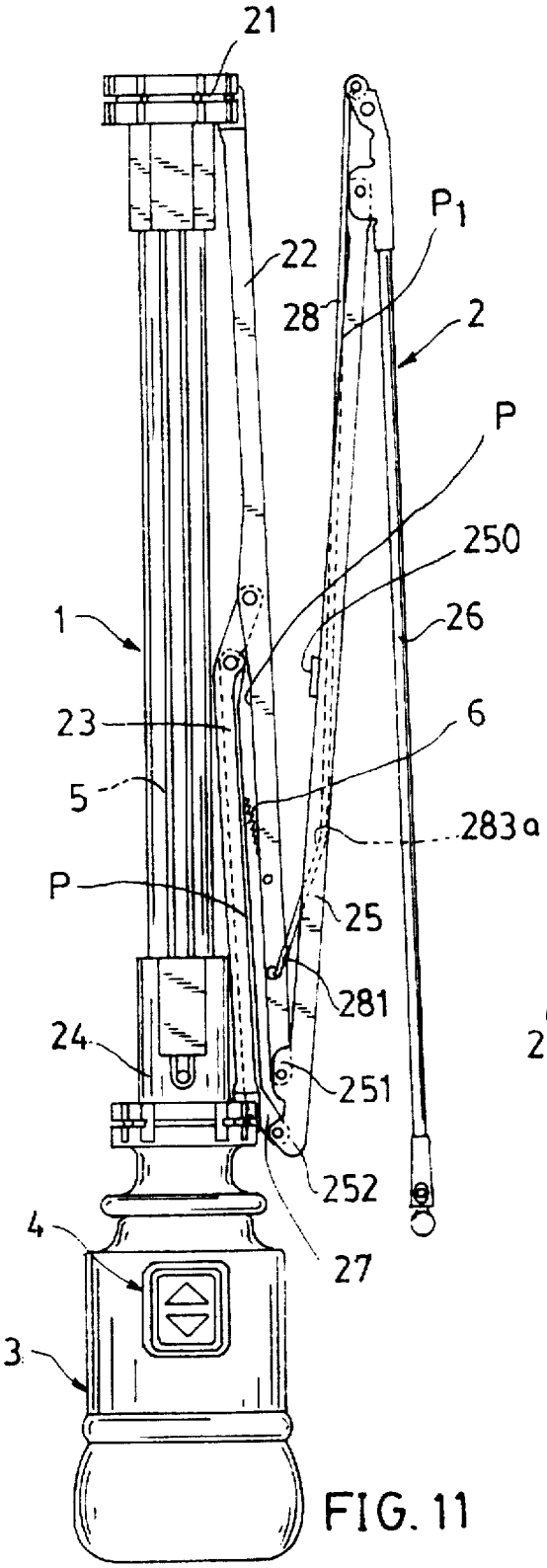
FIG. 11 shows a folded umbrella according to the present invention.
Figure 12:
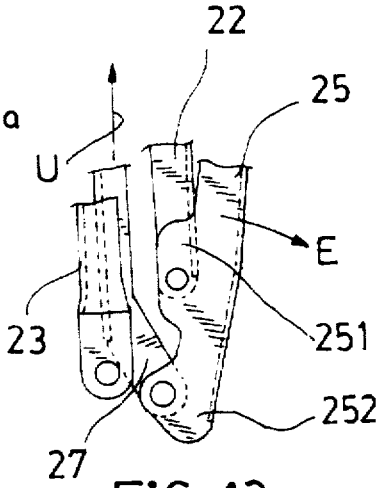
FIG. 12 shows a partial rib means of the present invention as shown in FIG. 11.

After folding the rib means 2 and closing the umbrella as shown in FIG. 11 having the opening spring 5 stored its spring energy, the concave deflection portion **283*a* having an obtuse angle formed thereon will slightly bias the second parallelogram linkage P1 outwardly and separately from the first parallelogram linkage P, thereby quickly initiating an extending (E) of the rib means 2** outwardly when raising the runner upwardly (U) for opening the umbrella for a quicker opening of the umbrella and for saving an opening force when opening the umbrella.

So, the present invention provides an automatic umbrella for quickly initiating a folding or unfolding operation for accelerating the closing or opening of the umbrella to be superior to the conventional automatic umbrella.

The present invention may be modified without departing from the spirit and scope of this invention.

I claim:

1. A rib means adapted for use in an automatic umbrella having an umbrella cloth secured thereon and a central shaft secured to a grip having a control device formed in the grip for controlling opening and closing of the umbrella, an opening spring resiliently retained in the central shaft for extending the rib means for opening the umbrella, and at least a closing spring secured on said rib means for folding the rib means for closing the umbrella;

said rib means including: a top rib having an inner end portion thereof pivotally secured to an upper notch fixed on a top of the central shaft, a stretcher rib pivotally connected between the top rib and a runner slidably held on the central shaft, a middle rib having a pair of lugs protruding upwardly from opposite side walls of an U-shaped groove of the middle rib for pivotally connecting an outermost end portion of the top rib on the pair of lugs of the middle rib, a rear rib having an inner portion pivotally connected with an outer end portion of the middle rib, an intermediate connecting rib having an inner end portion thereof pivotally connected to an outer portion of the stretcher rib and an outer end portion of the intermediate connecting rib pivotally connected with an innermost end portion of the middle rib, and a spring rib having an innermost hook portion pivotally secured to an outer portion of the top rib and having an outer end portion of said spring rib pivotally connected with an innermost end portion of the rear rib; and said closing spring secured between the intermediate connecting rib and said top rib;

the improvement which comprises:

said spring rib including a convex spring portion connected to the innermost hook portion of said spring rib and convex upwardly to override the outermost end portion of the top rib and at least one said lug of the middle rib and a concave deflection portion concave downwardly from the convex spring portion and obliquely orienting towards the U-shaped groove of the middle rib to be projectively align with a longitudinal axis defined at a longitudinal center of the middle rib, whereby upon tensioning by the umbrella cloth of an opened umbrella to compress the convex spring portion to store a spring energy of the spring rib, the convex spring portion will help initiate a folding of the rib means for quickly closing the umbrella when the umbrella is closed.

* * * * *